US005393002A

United States Patent [19]

Greis et al.

[11] Patent Number: 5,393,002

[45] Date of Patent: Feb. 28, 1995

[54] PROCESS AND DEVICE FOR THE CONSTITUTION OF A YARN END RESERVE WINDING ON YARN PACKAGES OF A TEXTILE MACHINE

[75] Inventors: Dietmar Greis; Walter Mayer, both of Ingolstadt, Germany

[73] Assignee: Schubert & Salzer Maschinenfabrik AG, Germany

[21] Appl. No.: 914,993

[22] Filed: Jul. 16, 1992

Related U.S. Application Data

[63] Continuation-in-part of Ser. No. 733,101, Jul. 19, 1991, abandoned.

[30] Foreign Application Priority Data

Jul. 21, 1990 [DE] Germany ..... 4023291

[51] Int. Cl.[6] ..... B65H 54/02

[52] U.S. Cl. ..... 242/18 OEW; 242/118.3

[58] Field of Search ..... 242/18 EW, 18 PW, 165, 242/164, 166, 167, 118.3, 118.31, 118.32

[56] References Cited

U.S. PATENT DOCUMENTS

| | | |
|---|---|---|
| 2,035,721 | 3/1936 | Reiners et al. . |
| 3,158,335 | 11/1964 | Deussen . |
| 3,751,898 | 8/1973 | Inaba et al. . |
| 4,025,002 | 5/1977 | Sutton, III et al. . |
| 4,384,689 | 5/1983 | Bloomfield et al. . |
| 4,438,624 | 3/1984 | Mayer et al. . |
| 4,630,782 | 12/1986 | Rohner . |
| 4,736,898 | 4/1988 | Raasch et al. . |
| 4,948,057 | 8/1990 | Greis . |
| 5,056,723 | 10/1991 | Inoue . |
| 5,104,051 | 4/1992 | Berg et al. . |

FOREIGN PATENT DOCUMENTS

| | | |
|---|---|---|
| 272998 | 4/1962 | Germany . |
| 1760243 | 12/1971 | Germany . |
| 2506930 | 9/1976 | Germany . |
| 3737122 | 8/1988 | Germany . |
| 3922719A1 | 1/1991 | Germany . |
| 4040552 | 6/1991 | Germany . |

*Primary Examiner*—Stanley N. Gilreath
*Attorney, Agent, or Firm*—Dority & Manning

[57] ABSTRACT

A method and apparatus for producing a yarn reserve, in particular on a cross wound package carried on a former which has an end which projects beyond the package. A groove is provided in the end portion for securing the yarn as the yarn is wrapped therearound before being brought back over the surface of the package for producing a yarn end reserve.

6 Claims, 8 Drawing Sheets

PROCESS AND DEVICE FOR THE CONSTITUTION OF A YARN END RESERVE WINDING ON YARN PACKAGES OF A TEXTILE MACHINE

This is a continuation-in-part of application Ser. No. 07/733,101, filed on Jul. 9, 1991, now abandoned.

BACKGROUND OF THE INVENTION

The instant invention relates to a process for the production of a yarn end reserve winding on packages of a textile machine by means of which a yarn end reserve is produced on the package after winding the package with a predetermined length or quantity of a yarn, as well as to a device to carry out the process.

The instant invention furthermore relates to a package former to wind up yarn into a package and to receive at least one yarn end reserve between the end of the former and the front of the yarn package, and a process for the production of the yarn end reserve.

A method consisting in winding up several parallel windings at the small end of the former so that the yarn end of the package can be easily found and grasped is known from DE-OS 17 60 243. A method consisting in winding up the yarn end at the former end by means of suction graspers whereby the textile package is rotated again in winding direction and the suction grasper stops at the end of the former is known from DE-OS 25 06 930.

A method of laying the desired length yarn which is destined for the yarn reserve into the nip formed by the front of the former and of the package by means of a service unit equipped with a yarn suction device and a yarn guiding device is known from DE 36 02 574. The nip as defined in DE 36 02 574 is the junction of the former and the side of the package which is identified by the reference character 41.

In the production of yarn reserves, it is furthermore known that the first windings of the yarn reserve are to be overlaid by the following ones in order to hold them on the former.

Yarn end reserves, in particular on conical formers where the yarn end reserve is laid on the small diameter end of the former, have the disadvantage that when the package is handled there is a risk that the yarn end reserve may slip off the former. The yarn end may be damaged in this way, and the advantage of easily locating the yarn end is lost. It is a known method to make markings in the form of flat impressions on the former in the area of the deposit of the beginning yarn reserve. Their role is mainly to prepare the former for the tightening of the yarn reserve. Slipping of the reserve winding on the former is difficult to prevent because of its flat form. But this is not necessary, since the yarn end reserve is subsequently overlaid and thus held in place.

SUMMARY OF THE INVENTION

It is a principal object of the instant invention to create processes and devices by means of which it will be possible to produce a yarn end reserve, especially with conical formers, in such manner that loosening or slipping of the yarn end reserve from the package former is prevented, as well as to design a former to receive the yarn end reserve. Additional objects and advantages of the invention will be set forth in part in the following description, or will be obvious from the description, or may be learned by practice of the invention.

By winding the yarn back on the circumferential surface of the package, the end of the yarn end reserve can be held securely. The yarn end then adheres to the packages with its hairy surface. Costly measures and devices such as have been used in the past which were unsatisfactory can be avoided. It suffices to guide the yarn end on the package. Precise positioning on the package in proximity of the nip between former and package is not required. It is especially advantageous for the yarn end to be pressed on the surrounding surface of the package after having been fed back. This produces an intensive contact which interlocks the yarn end with the surface of the package and thus holds it. This is accomplished most easily by means of the friction roller which may serve to drive the package during the formation of the yarn reserve.

For further processing of the package, it is advantageous for the yarn end reserve to be easily grasped. This is achieved in that the former is touched, at least in part, by the yarn of the yarn end reserve. The position of the yarn end reserve is thereby defined in relation to the former, so that especially automatic searching and grasping becomes possible. It is especially advantageous here to wind the yarn on the former at a defined location. This is especially easy to accomplish by using a former which is provided with a groove in accordance with the instant invention. The search for and the grasping of the yarn end reserve is possible also on the surface area of the package with a package made in accordance with the instant invention since the yarn end comes to lie on the surrounding surface of the package.

It is especially advantageous for the yarn to be under tension as it is being laid down because the yarn comes into contact with the package surface over its entire length. If the yarn is under tension, the yarn end reserve is also laid on the package former under tension. A well-tensed yarn end reserve reduces the tendency to slip on the former. An additional advantage in producing the yarn end reserve constructed in accordance with the present invention consists in laying a considerable portion of the yarn end reserve on the surrounding surface of the package. Thereby the yarn end reserve needs only little space on the former. Furthermore, the danger that the yarn end reserve may slip off the former is all the more reduced as less yarn is deposited on the former. When few windings are laid down, a simple and rapid grasping of the yarn end reserve is possible and the yarn end reserve slipping off the former is minimized.

An additional advantageous step according to the invention consists in winding the yarn parallel to the edge of the package in order to produce the yarn reserve before bringing it down from the surrounding surface of the package. This prevents the yarn on the package from loosing its tension and the yarn end reserve from becoming loose and thereby apt to detach itself from the former. It is especially advantageous to carry out the parallel winding at a distance from the edge of the package so that it may not slip off the package.

In another advantageous embodiment of the invention, provisions are made for the package to be stopped for the formation of the yarn reserve. It is especially time-saving to produce the yarn reserve without stopping the package or winding station. In addition the guidance of the yarn can be carried out advantageously by the yarn guide used for normal winding. The device of DE 3734478 A1 is especially well suited for this. The cutting of the yarn occurs after formation of the yarn end reserve.

By using a former in accordance with the invention it is possible to produce a yarn reserve in such a manner that it is substantially prevented from becoming detached from the former. The invention is especially advantageous with conical package formers. The yarn end reserve is most often produced on the small diameter end of the package former where sliding of the yarn end reserve sometimes causes it to become detached. This can be prevented through the presence of a groove. This form of diameter change is most advantageous since it does not prevent the rotation of the package former against the friction roller. A groove extending around the entire circumference of the former is especially advantageous because the difference between the length of the circumference at the bottom of the groove and on the former is as great as possible. A yarn segment lying in the groove can slip out of said groove only if its length increases. Since a change in length of the yarn is however practically not possible, the yarn is held in the groove. The yarn end reserve can thereby be held fast on the package former since the other windings of the yarn end reserve are kept under tension. Additional advantageous embodiments of the invention are described in the sub-claims.

BRIEF DESCRIPTION OF THE DRAWINGS

The invention is described below through drawings in which.

FIG. *7a* is an elevation view illustrating the small diameter end of a conical package former on which the area between groove and the package where the windings on the former would occur is polished over.

FIG. *7b* is an elevational view illustrating the end of a conical package former with a groove going in at an angle.

Figure 8:
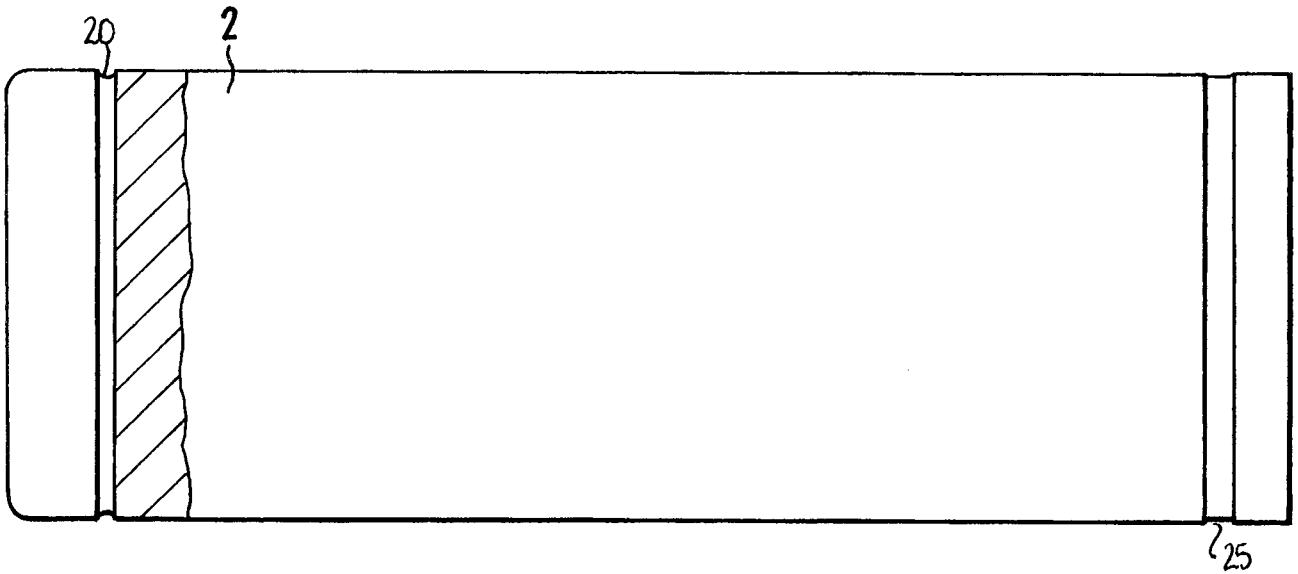

FIG. 8 is an elevational view of a cylindrical crimped package former designed in accordance with the invention;

FIG. *9a* is a side view of a portion of a package former shown in FIG. *9a* end with a wedge-shaped groove;

FIG. *9b* is a cross section of the end of a crimped package former shown in FIG. *9a*.

Figure 10:
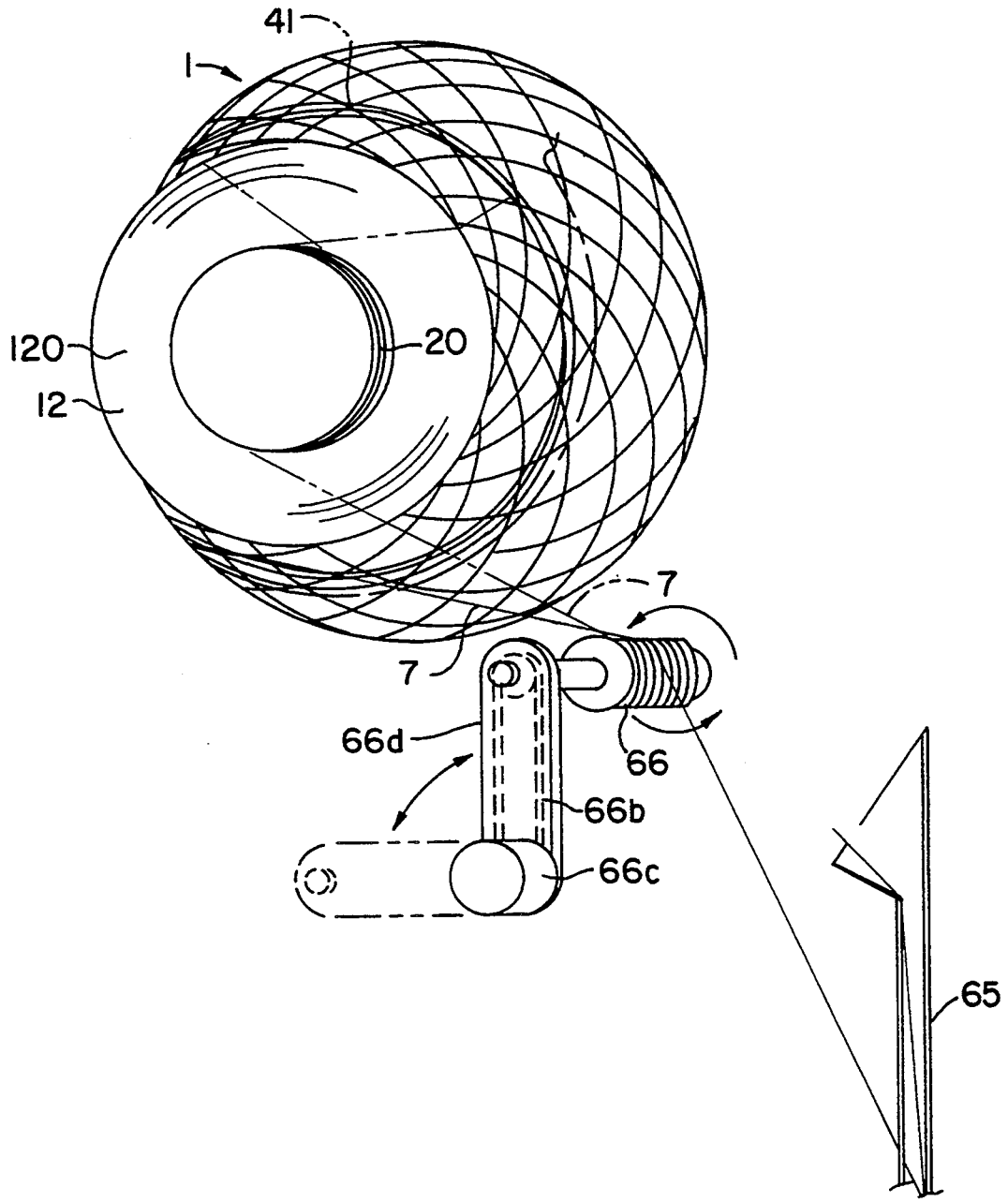

FIG. 10 is a perspective view illustrating yarn being wound on the end of a former.

Figure 11:
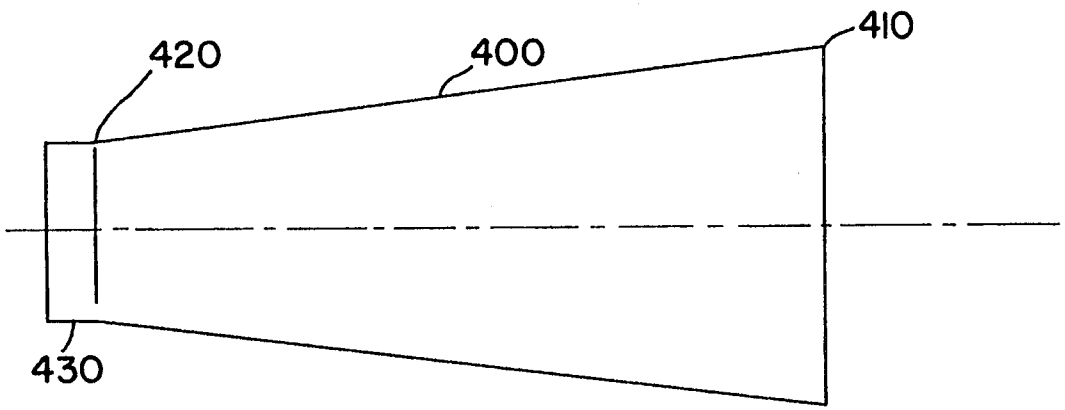

FIG. 11 is an elevational view of still another former constructed in accordance with the present invention.

DESCRIPTION OF THE PREFERRED EMBODIMENT

Reference will now be made in detail to the presently preferred embodiments of the invention, one or more examples of which are illustrated in the drawings. Each example is provided by way of explanation of the invention, not limitation of the invention.

Figure 1:
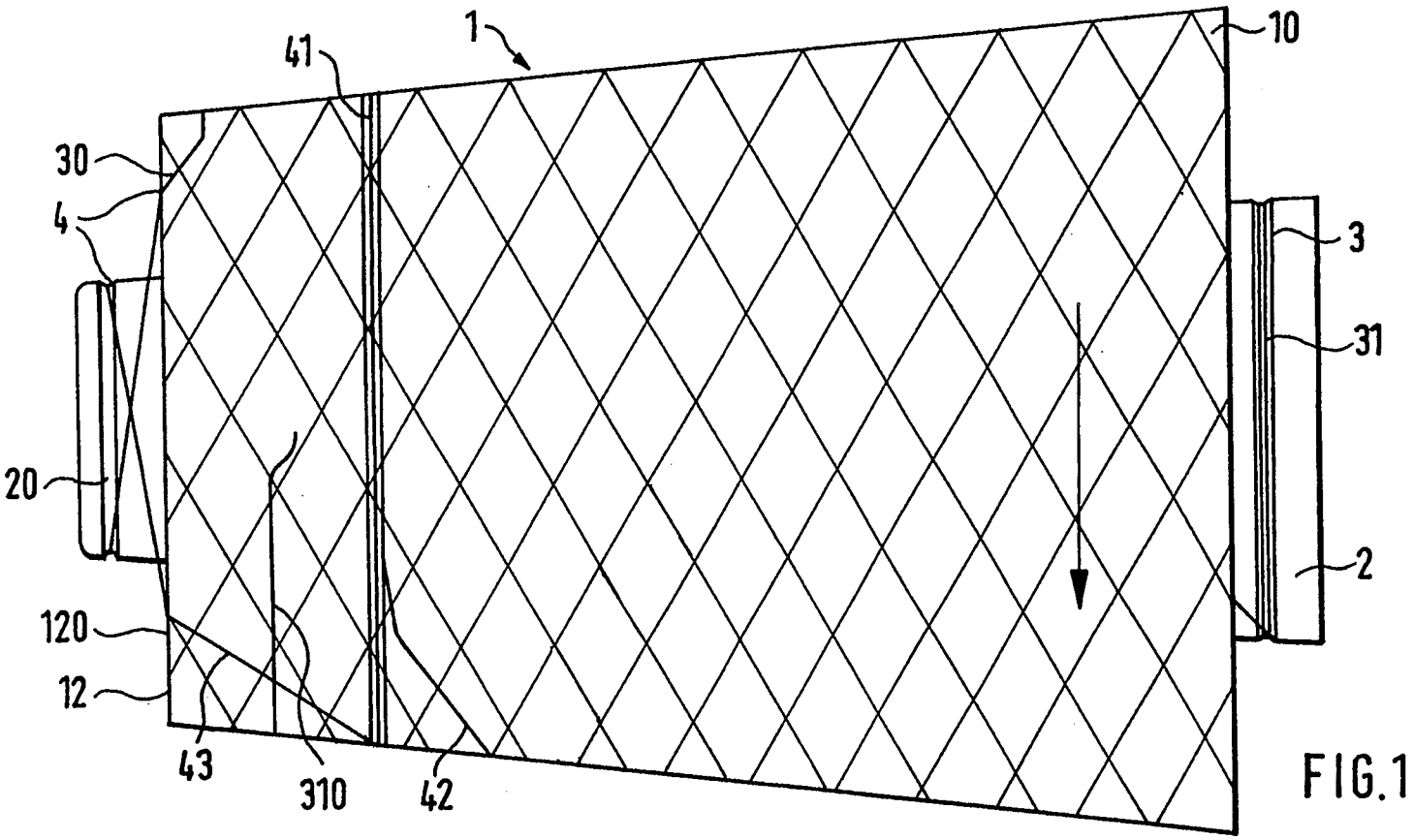
FIG. 1 is a completely wound conical elevation view of package with a yarn end reserve according to the invention.

The conical package of FIG. 1 has a yarn end reserve 31 produced in a known manner at the larger end of its package former 2 as well as a yarn end reserve 4 according to the invention at the small diameter end of the package former 2 which is provided with a groove 20 according to the invention. When the yarn 3 is first started on the package former 2, a yarn end reserve 31 is produced and a predetermined quantity of yarn is wound up, the spinning station is then stopped in a known manner and the feeding of yarn 3 is interrupted. After the winding station has been stopped, a command is transmitted to an automatic service unit to service the stopped winding station. This can be done by a package-replacement carriage, for example.

To produce the yarn end reserve, the yarn end of the stopped package is first located by the automatic service unit, the yarn end reserve is then formed and the package is taken out of its winding station. The package of FIG. 1 is completely wound with a yarn end reserve 4 and has already been taken out of the winding station.

Figure 4:
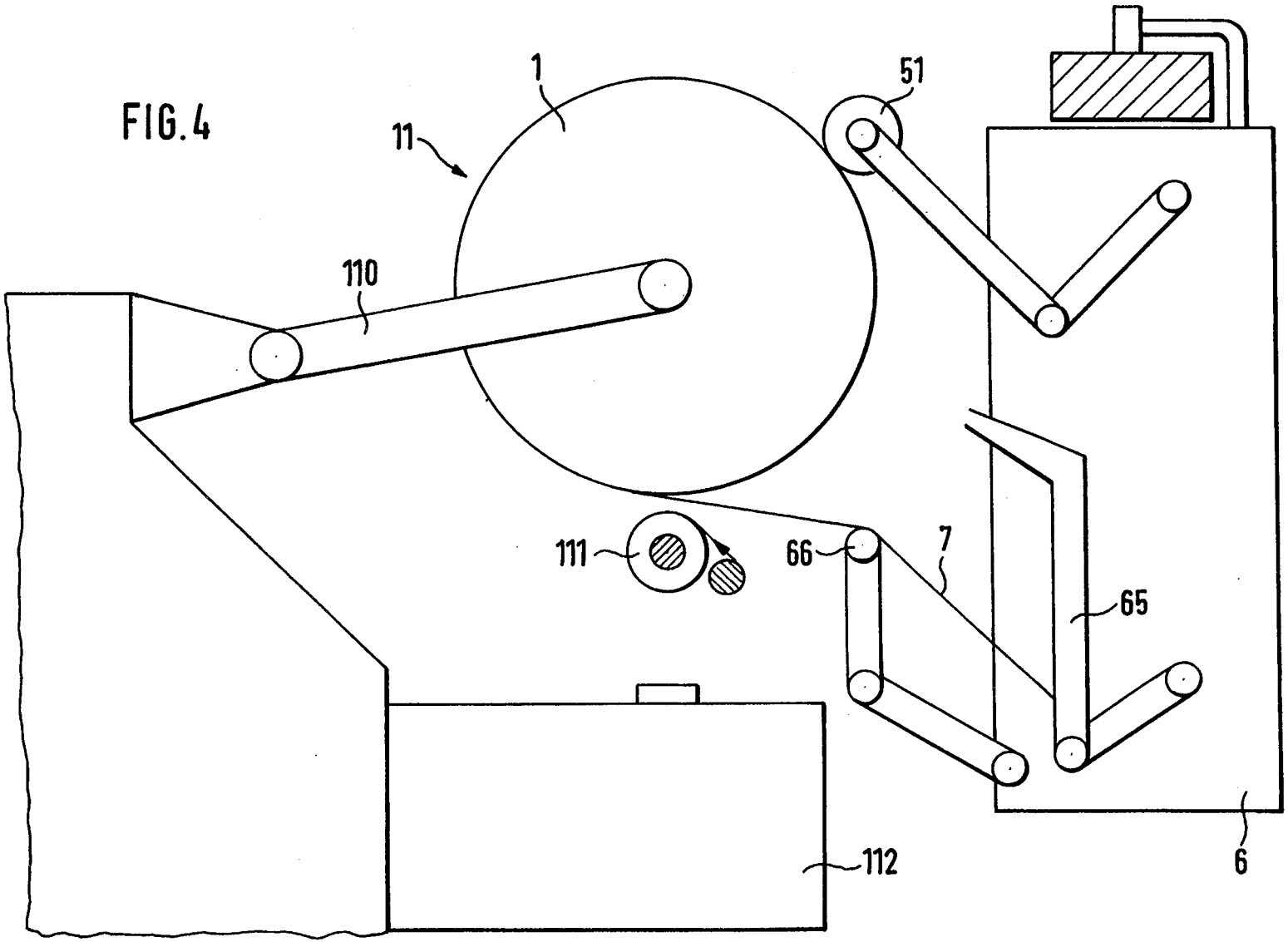
FIG. 4 is a side elevation view of a winding station designed in accordance with the invention.

Once the yarn end has been searched for and located, it is first unwound from the package and received in a suction device 65 (FIG. 4). The package is then rotated in the wind-up direction without traversing the yarn so that parallel windings 41 are formed on the package. This defined parallel winding of the yarn prevents a loop without tension from being produced when the yarn is brought down to form the yarn end reserve. After production of the parallel windings 41, a yarn guide guides the yarn laterally over the edge of the wound yarn, causing the yarn end reserve 4 to wind around the bobbin former 2 during continued rotation of the package before it is guided back in direction of the package by the yarn guide and is wound up by the package on its surrounding surface 10.

The start 42 of the parallel windings 41, where the yarn goes from normal traversing winding into parallel windings 41, is shown in FIG. 1. Starting at the parallel windings, a yarn segment 43 is guided to the edge 12 of the wound yarn. After being fed back to the edge 12 of the wound yarn, the yarn end 30 is guided on the surrounding surface 10 of the package 1 in the direction of the middle of the package and is deposited there. Thus the end segment 310 of the yarn end 30 comes to lie against the surrounding surface 10 of the package. Thanks to its hairiness the yarn end lays down firmly on the surrounding surface of the package. Since the entire surface of the package is also hairy, there is no danger that the yarn end 30 or the end segment 310 may become detached from the surrounding surface 10 of the package. The yarn end reserve 4 is thereby secured against slipping off the package former 2. During the production of the yarn end reserve and of the parallel windings 41, the yarn is held under tension until it is again guided back to the surrounding surface of the package 10. Since the yarn end reserve is at least slightly under tension, it is possible to prevent it with certainty from becoming detached from the bobbin former.

The yarn end reserve 4 wound on the former 2 is wound in a defined manner. This is especially simple to accomplish by means of the groove 20 defined in former 2. This defined positioning of the yarn end reserve on the former 2 ensures in further processing of the package that the yarn end reserve 4 can be safely found and grasped manually, as well as by machine.

In addition to the yarn end reserve 4 which runs at a distance from the front end 120 of the wound yarn, the elements of the yarn end reserve leading from the edge 12 of the wound yarn to the former 2 and back are also at a distance from the front or small end 120 of the wound yarn. Thus, removal by suction of the yarn end reserve for further processing of the package is rendered especially simple. Since the yarn end 30 is wound up on the surrounding surface 10 of the package 1, the yarn end reserve can also be drawn off from the surrounding surface of the package.

A further measure to ensure holding of the yarn end reserve consists in guiding the yarn segment 43 as well as the yarn end 30 at as steep an angle as possible to the edge of the wound yarn and back from same to and from the surrounding surface. For this, it is necessary to wind the parallel windings 41 at a greater distance from the edge 12.

Figure 2:
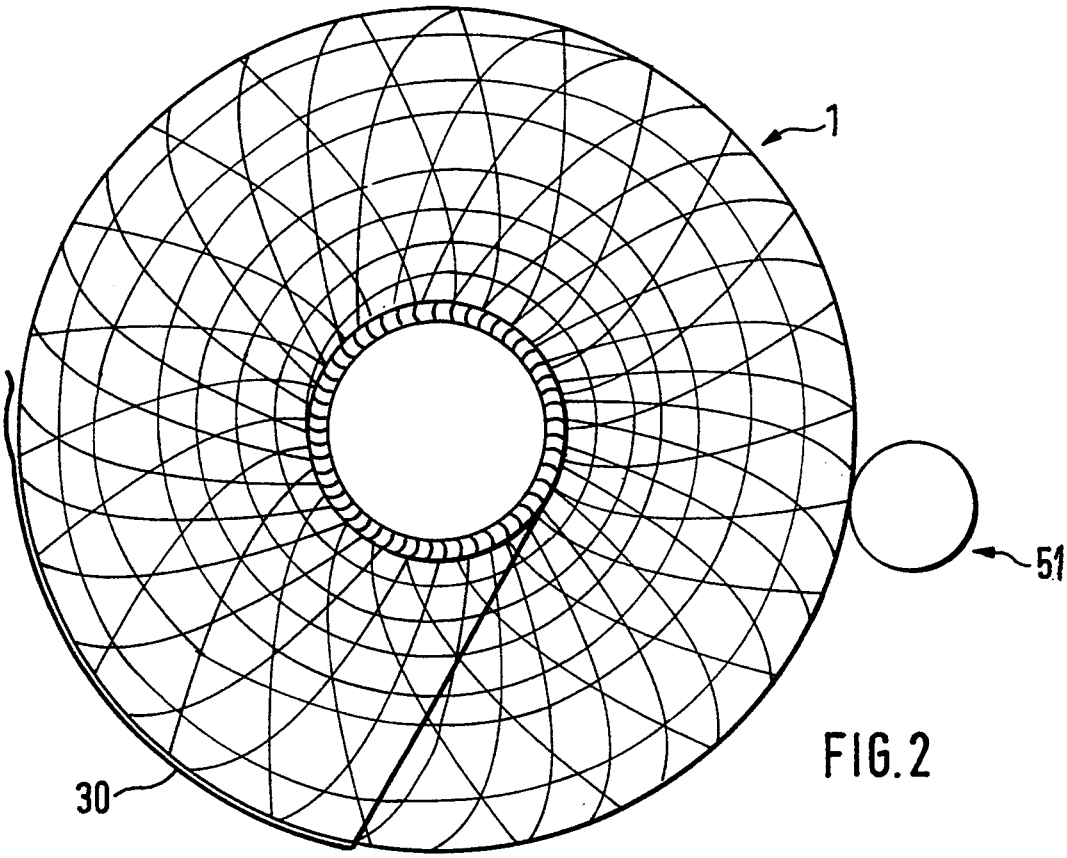
FIG. 2 is a side view of the package of FIG. 1 with the yarn end reserve of the present invention.

FIG. 2 shows a side view of a package similar to that of FIG. 1. In contrast to the latter, where the looping of the yarn around the former is less than 360 degrees, the looping around the former in FIG. 2 is approximately 2.5 times the circumference of the former. Crossing over between the descending and the rising portion of the yarn end reserve as here in FIG. 2 is not required. The yarn end 30 wound on the surrounding surface of the package 1 loops around the surface of the package for only approximately $\frac{1}{4}$ of its circumference. A short yarn end 30 makes it possible to detach the yarn end reserve easily from the package. The fact that a pressure roller 51 rolls over the yarn end and presses it against the surrounding surface after winding of the yarn end on the package ensures secure holding of the yarn end and thereby of the yarn end reserve 4. This causes the yarn end 30 to mesh with the surface of the package 10 so that it is prevented from slipping off. The drive roller 51 which rotates the package during yarn search is advantageously used as the pressure roller.

Figure 3:
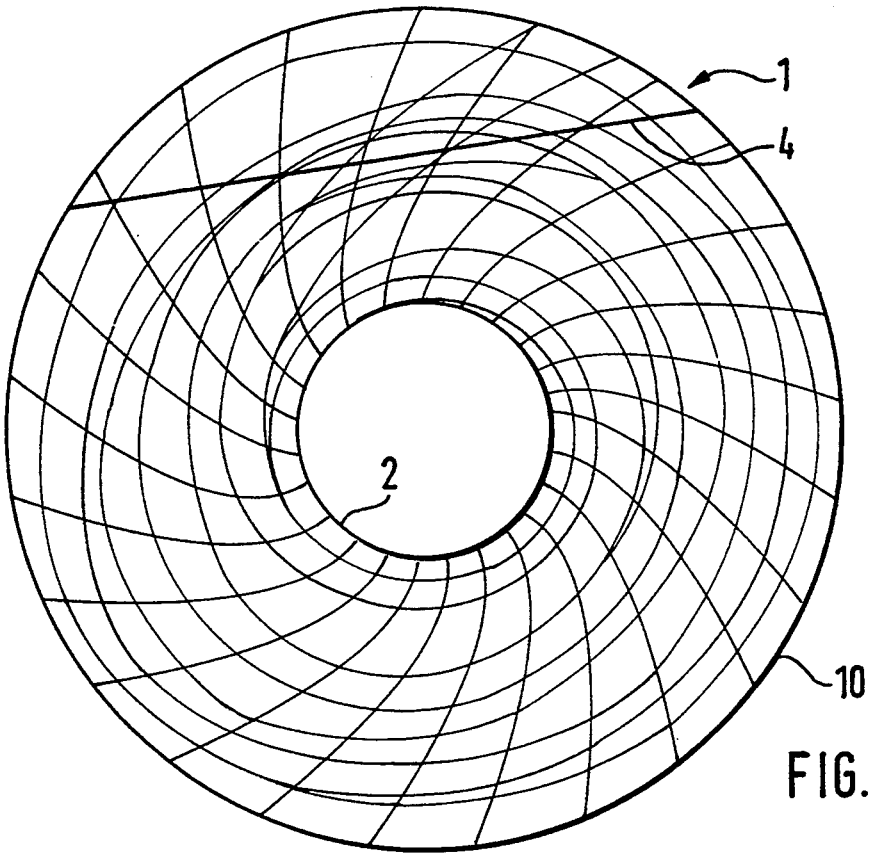
FIG. 3 is a side view of a package with a yarn end reserve according to the invention which is not deposited on the former.

FIG. 3 shows a side view of a package in which the yarn end reserve 4 is fed back to the surrounding surface without touching the former 2 after being brought down from the surrounding surface 10 of the package. This method of producing a yarn end reserve 4 makes it possible to wind the yarn reserve and the yarn end reserve 4 on the same side of the former without having one interfere with the other. In this manner, a yarn end reserve can also be produced if the former 2 does not extend or extends only very little beyond the front of the package 1. If the extension of former 2 is sufficient, it is possible for the yarn end reserve 4 to touch it or to partially loop around it.

FIG. 4 shows a winding station 11. A package 1 is held by an arm 110. This package 1 is lifted from its friction roller 111 to be stopped. No further thread continues to be delivered by the yarn delivery station 112 (represented schematically). A service carriage 6 has travelled into position in front of the winding station 11. This service carriage 6 is equipped with means to search for the yarn on the stopped package 1, means to drive the package and means to wind the yarn on the package. After stoppage of the package, for example when a predetermined yarn length or a predetermined quantity of yarn has been wound up, the service carriage 6 has brought itself automatically into position in front of the winding station. The package 1 is lifted from its normal driving means, the friction roller 111, which can also be used to wind the yarn on the package. In order to produce the yarn end reserve 4 which is formed by the service carriage 6, the yarn end which had been wound up on the surrounding surface of the package must first be located and grasped. This is effected in that the package is driven by the driving roller 51. The service carriage, by means of the driving roller 51, is able to rotate the package in both directions. Following this or simultaneously therewith, a device carried by the service carriage locates the yarn end. The device includes a pneumatic suction nozzle 65 which is brought into immediate proximity of the surrounding surface of the package and which thus subjects the latter's surface to suction. The suction nozzle 65 is here designed so that it subjects the entire package width to suction. Suction nozzle 65 typically includes a slit defined therein so that once the yarn end is located and sucked off of the package surface, the yarn runs through the slit into the nozzle 65, as in FIG. 4.

While the surrounding surface of the package is subjected to suction it is rotated by the drive roller 51 of the service carriage 6 in the unwinding direction. In this way the yarn end comes within range of the pneumatic suction nozzle 65 and is sucked into same. The moment when a sufficient quantity of yarn has been unwound from the package is determined by means of a monitoring device (not shown) which is installed within an air channel of the pneumatic suction nozzle. The suction nozzle then swivel back from the surrounding surface of the bobbin, as shown in FIG. 4, causing a yarn path 7 to be produced from the surface of the package through the slit in the nozzle. Once a predetermined quantity of yarn has been unwound from the package, the drive roller 51 is stopped. A yarn guide for the winding of the yarn then swivels into the yarn path 7. This guide is made in the form of a threaded spindle 66. The yarn path 7 is here selected so that when the yarn 3 has been guided down to produce the yarn end reserve on the former 2, the yarn continues to remain within range of the yarn guide. This ensures that the yarn can again be brought back on the surrounding surface of the package.

Figure 5:
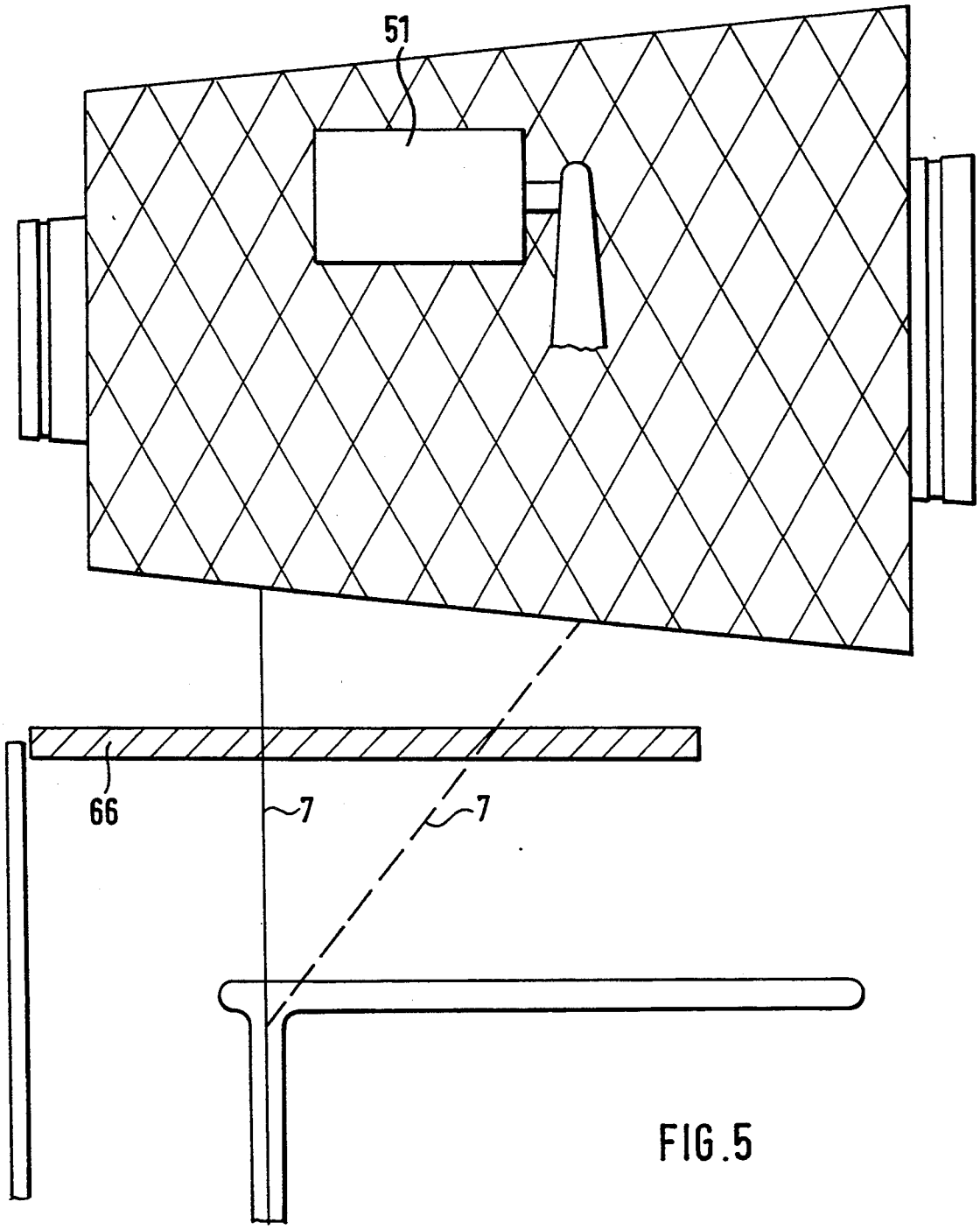
FIG. 5 is a front view of the winding station of FIG. 4.

Referring to FIG. 5, the threaded spindle 66 has threads 66*a* running in one direction along the length of the spindle. When the spindle 66 is driven one direction in contact with the yarn, the yarn will be shifted to the left as seen in FIG. 5. Upon reversing the direction of drive of the spindle 66, the yarn is shifted to the right as seen in FIG. 5. Any suitable conventional spindle can be used for shifting the yarn laterally. One suitable spindle drive is disclosed in U.S. Pat. No. 4,438,624. It is especially advantageous for the yarn guide or spindle 66 to be brought into immediate proximity of the surface of the package because this facilitates the return of the yarn back to the surrounding surface. When the yarn guide 66 has been guided back into the yarn path 7 of the yarn, the drive roller 51 is set in motion in a reverse direction of rotation so that the yarn is at first wound up once more on the surface of the package. In this action, no traversing of the yarn takes place so that, depending on the time during which the drive roller is switched on and which must be adapted to the desired length of the yarn, one or several parallel windings 41 (FIG. 1) are wound up on the package. The point where the parallel windings are wound up on the package depends on how the yarn has been held by the pneumatic suction nozzle. If the yarn guide 66 has already been swivelled into the yarn path 7, it can determine the position of the parallel windings.

Upon completing production of the parallel windings the yarn guide or spindle 66 is set in motion so that the yarn is taken out over the edge of the package and drops on the package former 2. In this process, the developing yarn surplus is taken up by the suction of the pneumatic suction nozzle 65. At the same time or following the yarn's slipping onto the package former, the package is rotated in the wind-up direction to produce the yarn end reserve. Depending on the duration or this winding-up, more or less of a yarn end reserve is produced. To feed the yarn back on the surface of the package, spindle 66 is set in motion in the opposite direction so that the yarn is taken by the spindle over the edge of the wound yarn and onto the surrounding surface of the package. During the entire process the yarn is kept under tension by the suction nozzle. The yarn which had previously been sucked into the suction nozzle is wound on the package by rotating the package. If it is desired that as little yarn as possible be deposited on the surface of the package, the yarn can be cut. The continuous rotation of the package produced by the driving means 51 causes the yarn end to be securely held on the package. This can also be effected in that the package is lowered into its friction roller 111 which drives the package. Following the production of the yarn end reserve, the package can be taken out of the winding station in a known manner by a package replacement carriage or by the service carriage and can be replaced by an empty former.

In FIG. 5 the relative positioning of the suction nozzle 65 and of the spindle 66 in relation to the package 1 is shown in a top view. The asymmetric configuration of the pneumatic suction nozzle makes it possible for the yarn to be brought within range of spindle 66 upon being grasped, so that the latter is able to receive the yarn in its guide grooves or threads 66*a* by swivelling into the yarn path 7. The yarn emerges through a slit in the suction nozzle, as discussed. Either suitable positioning of the drive roller 51 or sufficient winding of the yarn end by the spindle 66 ensures that the drive roller 51 rolls over the yarn end for pressure contact.

Figure 6:
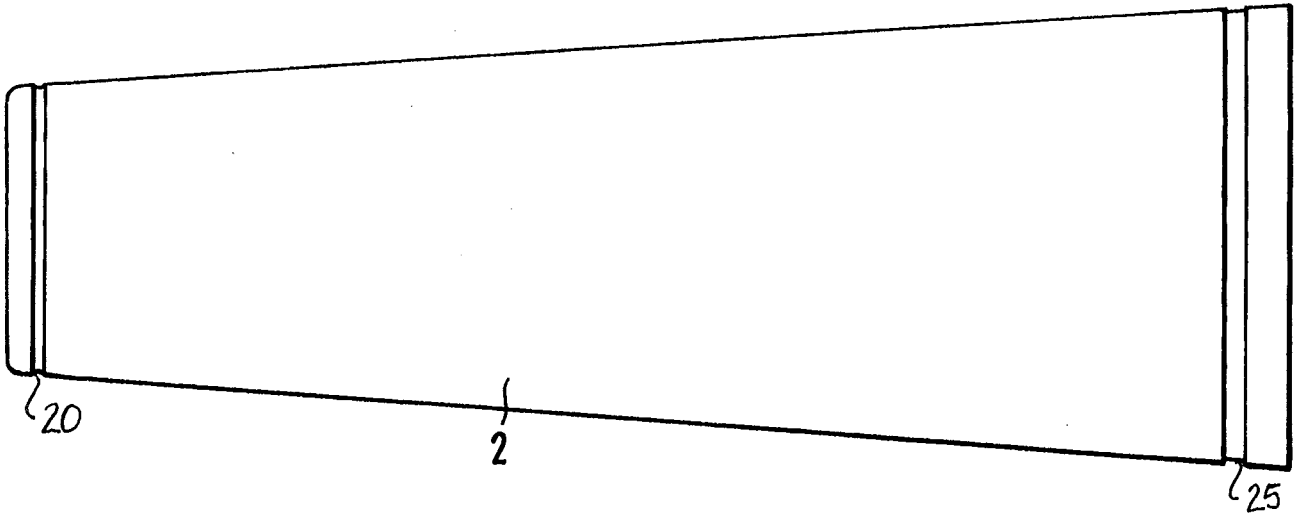
FIG. 6 is an elevation view of a conical former designed in accordance with the invention.

FIG. 6 shows a package former 2 according to the invention. It is here in the form of a conical, crimped former. At its end with the large diameter it is provided with a groove-shaped marking 25 to receive the initial yarn reserve. At its end with the smaller diameter, the former 2 is provided according to the invention with a diameter transition in the form of a groove 20. This end has a crimp 206 (as best seen in FIG. 9*b*) for better run-off of the yarn during further processing of the package. To ensure better run-off of the yarn, the area of the edge 26 is designed so that the yarn is able to run with little friction over the edge of the package former. In paper package formers, this is achieved by polishing over the surface. In this area, the groove 20 according to the invention is located.

In order to ensure easy entry of the yarn end reserve into the groove 20, the package former 2 is additionally provided according to the invention with an especially good surface quality, e.g. one with a low coefficient of friction in the area between the groove 20 and the area in which the windings of the package come to lie. This ensures that the yarn end reserve is sure to come to lie easily in the area of the groove 20. If there is little friction in the package former area between the groove and the front end of the package, there is no danger for a yarn end reserve winding to be produced outside the groove 20. This winding could become detached from the package former over time and slide in the direction of the package former end, causing the yarn end reserve to lose its tension and creating the danger that it might detach itself from the package former.

Figure 7A:
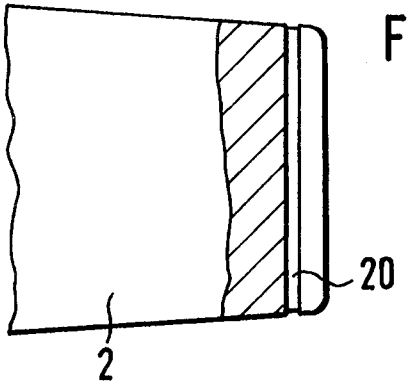

FIG. 7*a* shows a conical package former end on which, in addition to the area of the package former end which is provided with a lower coefficient of friction for the sake of better runoff, and contrary to the conventional design in which it is kept rough in the area of a yarn end reserve, this area is also given a low coefficient of friction. This especially assists the effectiveness of the groove 20 and ensures secure holding of the yarn end reserve. This area is shown by hatch marks. Here too, the low coefficient of friction, e.g. in the case of paper package formers, can be produced by polishing over the package former. When the yarn has been taken down from the surrounding surface of the package, the low coefficient of friction in combination with the yarn tension ensures that the yarn is guided along the incline of the conical package former in the direction of the groove and is immediately deposited in same. Later detaching of the yarn end reserve is thereby reliably prevented.

Figure 7B:
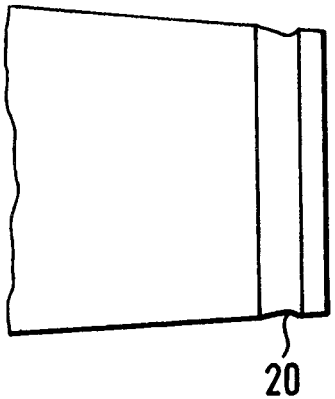

FIG. 7*b* shows the smaller end of a conical package former which is not made in the form of a crimped package former. It is provided with a groove 20 according to the invention in the area of the winding of the yarn end reserve, said groove being provided with a steep rise on the side towards the package former end while having a relatively flat transition to the surface of the package former on the other side. This also enables the yarn to slide more easily into the groove and ensures that the yarn end reserve is held more securely within the groove 20. In addition, the coefficient of friction of the package former surface can be reduced here too. By designing the groove bottom with a greater coefficient of friction, the yarn is caused to be slaved by the package former as the yarn end reserve windings are produced, so that the windings of the yarn end reserve are held under tension on the package former.

FIG. 8 shows a cylindrical package former 2 designed in accordance with the invention. One end is crimped and provided with a groove 20 to receive the yarn end reserve. The area between the groove 20 and the windings of the package is treated so that its coefficient of friction is lower than that of the area holding the package windings. In the case of paper package formers in particular, this is accomplished mainly by polishing over the surface. Subsequent lacquering can further reduce the coefficient of friction. The groove-shaped marking 25 for the winding of the initial yarn lead reserve is made at the opposite end of the package former.

It is especially economical to make the package former as a paper former. This has also the advantage that the groove can be produced easily. To produce the groove, the package former is placed on an internal mandril and the groove is pressed into the surface of the package former from the outside by means of a pressing tool. Another method for the production of the groove consists in rolling a roller over the package former end to impress the groove into it. It is especially advantageous in that case to design the crimping in such manner that it extends underneath the groove on the inside of the package former.

When the groove has been produced, the end of the package former is polished over to lower the coefficient of friction. Polishing after production of the former prevents the coefficient of friction from being lowered in the groove too. This is advantageous for the grasping of the yarn by the package former as the yarn end reserve is constituted.

Figure 9A:
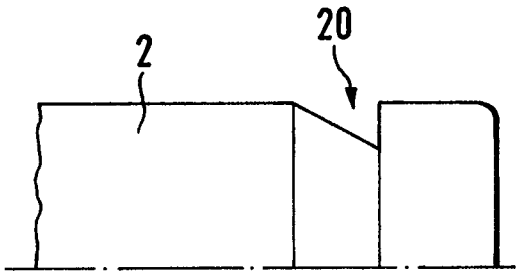
Figure 9B:
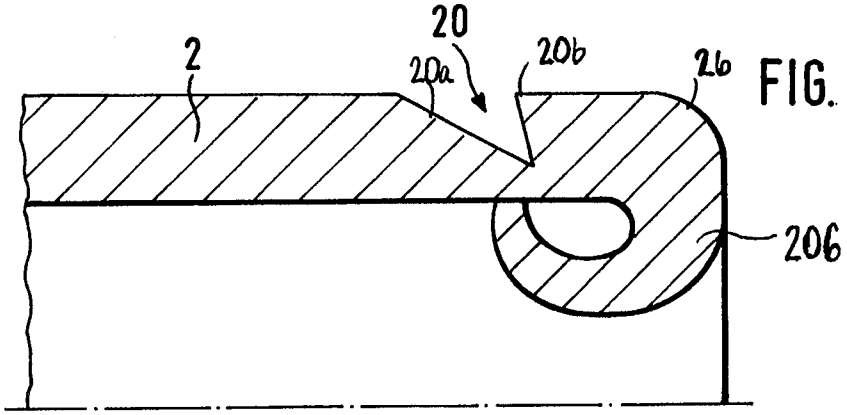

FIGS. 9*a* and 9*b* show ends of formers 2 on which the groove 20 is wedge-shaped. The wedge angle of FIG. 9*b* is smaller than that of FIG. 9*a* in that the side 20*a* extends at an angle under lip 20*b*. The wedge-shaped configuration of the groove 20 makes it possible for the yarn end reserve to wedge itself into the groove 20 and thus to be held fast. The wedge-shaped groove can also be made so as to be symmetrical.

FIG. 10 illustrates the yarn guide or spindle 66 with the threads provided thereon engaging the yarn 7 as it extends from the package to the suction nozzle 65. The spindle 66 can be driven in either direction as indicated by the arrows through a linkage 66*b* and a motor 66*c*. The linkage 66*b* is carried with an arm 66*d* that can be pivoted into the path of the yarn 7 for shifting the yarn laterally.

The dimensions of the groove are also determined by the thickness of the yarn constituting the yarn end reserve. For the windings to become wedged in, the groove must be so deep that several layers of yarn can be deposited therein. For this, a depth of more than twice the thickness of the yarn is required. Independently of the depth of the groove itself, it is especially advantageous for the groove bottom to be more than 0.5 mm lower than the prolongation of the surface line of the groove. This ensures undisturbed rolling of the package former against its friction roller.

The yarn end reserve can be held in place merely by using the package former made according to the invention since the yarn end becomes wedged between a winding of the yarn end reserve already lying in the groove and the groove wall. The yarn end reserve is held even more securely if it is furthermore constituted according to the process of the invention by which the yarn is fed back to the surrounding surface of the package.

FIG. 11 shows still another former that could be used for producing the desired yarn end reserve. The former includes an elongated frustro-conical shaped main body portion 400 which has an enlarged diameter end 410 and a small diameter end 420. A cylindrical end portion 430 is integral with the small diameter end 420 of the main body portion. The purpose of the cylindrical end portion is to receive a wrap of yarn when forming the reserve on the package. The end of the yarn can be wrapped partially around the cylindrical end portion or more than one wrap can be taken around the end portion before the end of the yarn is brought back over the surface of the package.

It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

What is claimed is:

1. A process for producing a yarn end reserve on a cross-wound package which is carried on a conical package former having end portions extending beyond the side of the wound yarn package, the smaller end portion of the conical package former defining a cylindrical portion, the process comprising:

unwinding the package to withdraw a length of yarn from the package;

rotating the package in the normal winding direction;

deflecting the withdrawn yarn onto the cylindrical end portion of the package former as the package is rotated in the normal winding direction causing the yarn to wrap around the surface of the cylindrical end portion; and deflecting the withdrawn yarn end over the side of the package for laying the withdrawn yarn end on the surface of the package.

2. The process as set forth in claim 1, further comprising holding the withdrawn yarn under tension while the yarn is being deflected to be wrapped around the cylindrical end portion of the package former and over the surface of the package.

3. The process as set forth in claim 1, further comprising wrapping the yarn with more than one winding as the yarn is wrapped around the cylindrical end portion of the package former.

4. The process as set forth in claim 1, wherein the yarn is wrapped around the cylindrical end portion approximately 180°.

5. The process as set forth in claim 1, further comprising pressing the yarn against the surface of the package as the yarn is being laid onto the surface.

6. The process as set forth in claim 1, further comprising forming a plurality of parallel windings on the package before deflecting the withdrawn yarn onto the cylindrical end portion of the package former.

* * * * *